US012588746B2

(12) United States Patent
Henry

(10) Patent No.: US 12,588,746 B2
(45) Date of Patent: Mar. 31, 2026

(54) COSMETIC APPLICATION DEVICE AND METHOD

(71) Applicant: Jane M. Henry, North Hollywood, CA (US)

(72) Inventor: Jane M. Henry, North Hollywood, CA (US)

( * ) Notice: Subject to any disclaimer, the term of this patent is extended or adjusted under 35 U.S.C. 154(b) by 271 days.

(21) Appl. No.: 18/141,458

(22) Filed: Apr. 30, 2023

(65) Prior Publication Data

US 2023/0346106 A1 Nov. 2, 2023

Related U.S. Application Data

(60) Provisional application No. 63/337,063, filed on Apr. 30, 2022.

(51) Int. Cl.
*A45D 34/04* (2006.01)

(52) U.S. Cl.
CPC ..... *A45D 34/041* (2013.01); *A45D 2200/10* (2013.01)

(58) Field of Classification Search
CPC .. A45D 34/041; A45D 34/06; A45D 2200/10; A45D 2200/25; A45D 33/12; A45D 40/26; A45D 40/261; B41M 1/26; B41M 1/40; B41K 1/42; B41K 1/22; A61K 8/00; B05C 17/0207; B05C 17/04; B05C 17/0355
USPC ..... 492/19, 20, 26, 28–37, 48, 205, 56; 29/895–895.33; 15/230, 230.11, 230.16; 101/328–331; 401/218–220
See application file for complete search history.

(56) References Cited

U.S. PATENT DOCUMENTS 1,551,260 A * 8/1925 Michaels ..... B05C 17/0217 101/376
1,555,585 A * 9/1925 Kings ..... B41K 1/22 101/375
6,305,045 B1 * 10/2001 Walsh ..... B05C 17/0207 220/570
2016/0316892 A1 * 11/2016 Giron ..... G03G 13/04
2020/0196732 A1 * 6/2020 Mahoney ..... A45D 34/041

OTHER PUBLICATIONS

Clarivate Analtyics copyrighted translation of KR20110009046U; publication date Sep. 23, 2011 (Year: 2011).*

* cited by examiner

*Primary Examiner* — Thomas C Barrett
*Assistant Examiner* — Sarah Woodhouse
(74) *Attorney, Agent, or Firm* — Cohen IP law Group PC; Michael N. Cohen

(57) ABSTRACT

A cosmetic application device and method of use. The cosmetic application device includes a roller adapted to apply cosmetics (and/or other types of products such as face paint, adhesives, glitter, etc.) to a person's skin. The device includes a handle configured with a roller. The roller includes embossed patterns or images on its outer surface that, once coated with cosmetics, may be transferred to a user's skin using a rolling process. The device also includes a feedback system that guides the user during the rolling process.

4 Claims, 4 Drawing Sheets

COSMETIC APPLICATION DEVICE AND METHOD

FIELD OF THE INVENTION

This invention relates to cosmetics, including a cosmetic roller applicator.

BACKGROUND

A wide variety of cosmetic application tools are available to individuals as well as make-up artists of all kinds. These tools typically include brushes, sponges, pencils, pens, and other types of application tools.

However, such tools are often cumbersome and limiting in the types and/or patterns of cosmetics that they may apply.

Accordingly, there is a need for a roller cosmetic application device.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the cosmetic application device and method according to exemplary embodiments herein includes a roller adapted to apply cosmetics (and/or other types of products such as face paint, adhesives, glitter, etc.) to a person's skin. In general, the device includes a handle configured with a roller. The roller may include embossed patterns or images on its outer surface that, once coated with cosmetics, may be transferred to a user's skin using a rolling process. The device also includes a feedback system that guides the user during the rolling process.

Figure 1:
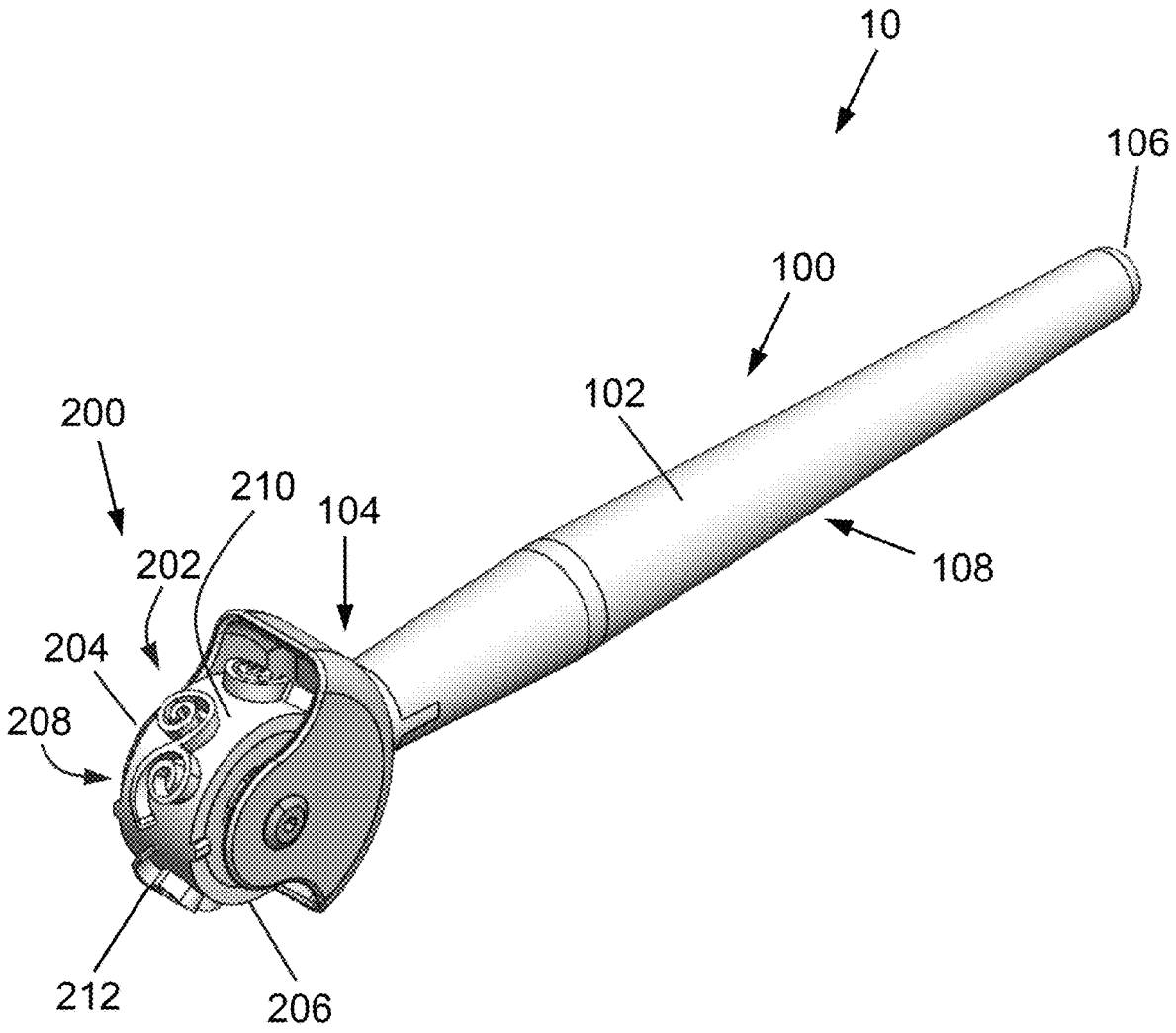
FIG. 1 shows a schematic of a cosmetic application device according to exemplary embodiments hereof.
Figure 2:
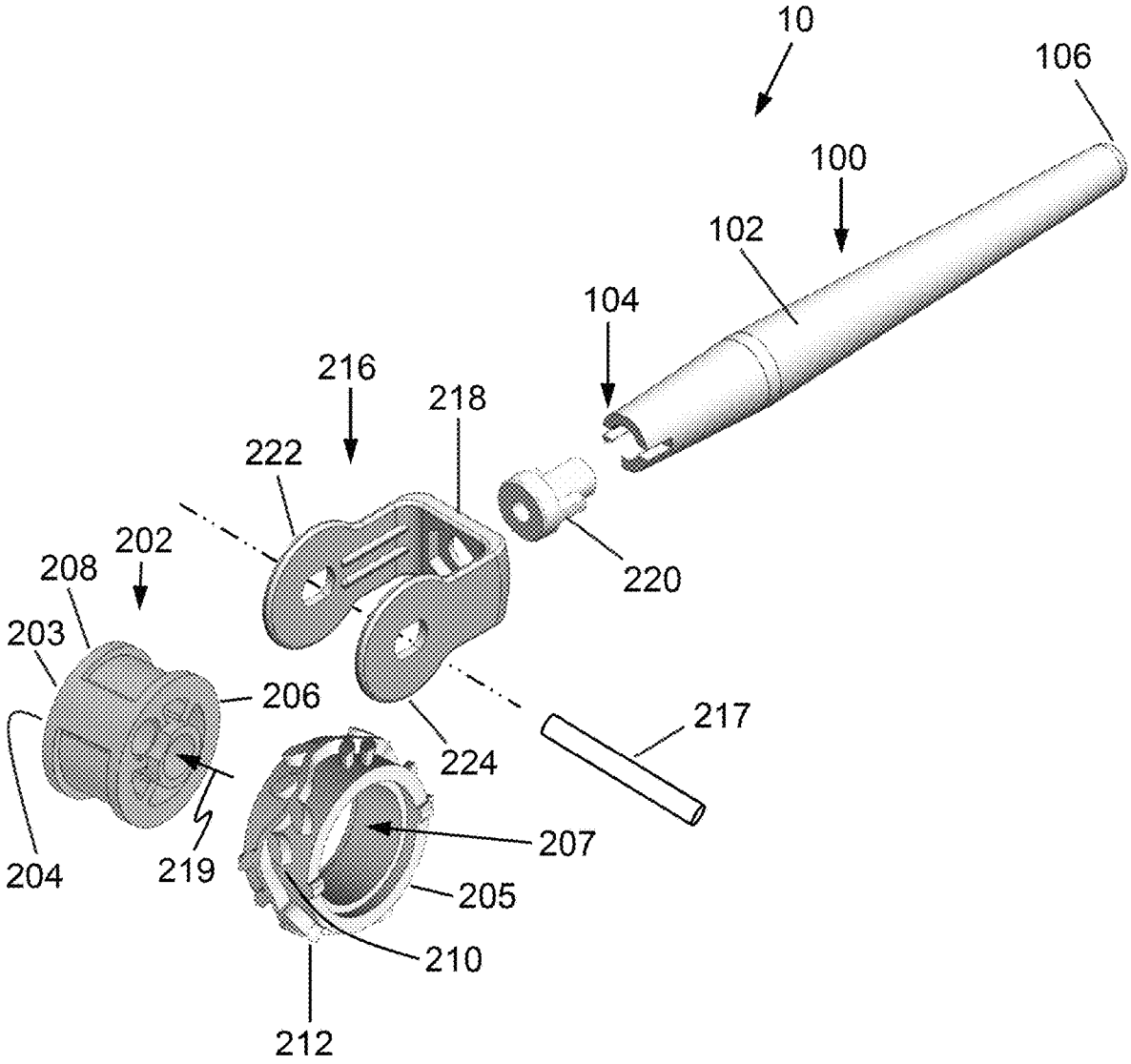
FIG. 2 shows an exploded view of a cosmetic application device according to exemplary embodiments hereof.

FIG. 1 shows an isometric view of a first embodiment of a cosmetic application device 10, and FIG. 2 shows an exploded view of a second embodiment of the device 10.

In one exemplary embodiment hereof, as shown in FIGS. 1-2, the cosmetic application device 10 (also referred to herein as simply the device 10) includes a handle assembly 100, a roller assembly 200, and a feedback system 300. In general, the handle assembly 100 provides a structure that may be gripped by a user for use of the device 10, the roller assembly 200 is configured to one or both ends of the handle assembly 100 and acts as a cosmetic applicator, and the feedback system 300 provides haptic feedback to the user during use of the device 10. The system 10 also may include other elements and components as necessary for the system 10 to fulfill its intended functionalities.

For the purposes of this specification, the device will be described predominantly with respect to its use as a cosmetic applicator. However, it is understood that the device may be used to apply other types of products to a person's skin in any area on the user's body. For example, the device may be used to apply face paint, glitter, adhesive, lotion, other types of products, and any combinations thereof. It also is understood that the scope of the device is not limited in any way by the types of products that it may be used to apply.

In some embodiments, the handle assembly 100 includes an elongate member 102 with a first end 104, a second end 106, and a handle body 108 extending between the first end 104 and the second end 106. The handle assembly 100 may be solid, hollow, and/or any combinations thereof. In some embodiments, the handle body 108 may include a circular cross-section, a hexagonal cross-section, an oval cross-section, any other suitable cross-sectional shape(s), and any combinations thereof. In some embodiments, the handle body 108 may comprise plastic (e.g., preferably post-consumer recycled (PCR)), rubber (e.g., a rubber grip), composite materials, metal, wood, cork, other types of suitable materials, and any combinations thereof.

In some embodiments, the roller assembly 200 includes a barrel 202 (also referred to as an art roller) including a first end 204, a second end 206 (generally opposite the first end), and a barrel body 208 extending between the first end 204 and the second end 206. The barrel body 208 includes an outer circumferential surface 210, that may be smooth and/or include a surface texture. In some embodiments, the surface 210 may include embossed structures and/or patterns 212. In this way, as will be described in other sections, cosmetics may be applied to the surface 210 and subsequently transferred from the surface 210 to a user's skin.

In some embodiments, as shown in FIG. 2, the barrel 202 may include an inner barrel portion 203 and an outer barrel portion 205 that together form the overall barrel 202. In some embodiments, the outer barrel portion 205 may include the outer circumferential surface 210 that may include the embossed patterns 212. As shown, the outer portion 205 may include a through opening 207 that may generally receive the inner barrel portion 203 and secure it therein to form the overall barrel 202. In this way, as described in other sections, when the barrel 202 is removed, the outer barrel portion 205 may be removed from the inner barrel portion 203 and interchanged with a different outer portion 205 that may include different embossed patterns 212.

In some embodiments, the barrel 202 comprises rubber, plastic, wood, composite materials, other suitable materials, and any combinations thereof. In some embodiments, the barrel 202 generally includes a circular cross-section. However, it is understood that other shaped cross-sections also may be used (e.g., oval). In some embodiments, the diameter of the barrel 202 may be generally constant between the first end 204 and the second end 206 while in other embodiments the diameter may vary. For example, in some embodiments, the barrel 202 is cylindrical, spherical, cone-shaped, truncated cone-shaped, other shapes, and any combinations thereof.

In some embodiments, as shown in FIG. 2, the roller assembly 200 includes a barrel support assembly 216 configured to couple a roller assembly 200 to the first or second end 104, 106 of the handle assembly 100. In some embodiments, the barrel support assembly 216 includes a support beam 218 coupled transversely to the handle's first or second end 104, 106, preferably at a midpoint on the beam 218, using a coupler 220. The coupler 220 may include a first end that may be releasably coupled to the support beam 218 (e.g., using a bolt and nut, screw, adhesive, or other attachment mechanisms) and a second end that may be releasably coupled to the first or second end 104, 106 of the handle assembly 100 (e.g., within a hole, slot, etc., and by using pressure fit, adhesive, a threaded juncture, etc.). These interfaces also may be fixed.

In some embodiments, a first portion of the beam 218 extends away from the handle assembly 100 in a first direction and a second portion of the beam 218 extends away from the handle assembly 100 in a second direction. In some embodiments, the second direction is generally opposite the first direction. In some embodiments, the coupler 220 fixedly attaches the barrel support assembly 216 to an end of the handle assembly 100 so that it may not move relative to the handle assembly 100. In other embodiments, the coupler 220 includes a hinge joint so that the barrel support assembly 216 is free to move about two axes of freedom relative to the handle assembly 100 (preferably with a locking mechanism), a ball joint so that the barrel support assembly 216 is free to move about three axis of freedom relative to the handle assembly 100 (preferably with a locking mechanism), and/or other types of joints.

In some embodiments, the support beam 218 includes a first arm 222 coupled to the distal end of its first portion and a second arm 224 coupled to the distal end of its second portion. The first and second arms 222, 224 preferably extend in the same direction (e.g., perpendicularly away from the support beam 218) and generally mirror one another (e.g., are opposing).

As will be described next, the barrel 202 is generally rotatably held between the first and second arms 222, 224 so that the barrel 202 may rotate in the direction of the arrow A in FIG. 3 as described herein during use.

In some embodiments, as shown in FIG. 2, the barrel body 208 includes an axial through hole 219 that extends through the barrel body 208 (preferably centered) from its first end 204 to its second end 206 thereby defining the barrel's axis of rotation. An axial rod 217 (also referred to as a core or spool) passes through the through hole 219 from the barrel's first end 204 to its second end 206 about which the barrel 202 may rotate. In some embodiments, a first end of the axial rod 217 is coupled to the support beam's first arm 222 and . . . the support a second end of the axial rod 217 (e.g., the end opposite the first end) is coupled to the support beam's second arm 224. For example, the first and second arms 222, 224 may include holes that may receive and secure the axial rod 217 as shown in FIG. 2.

In some embodiments, the axial rod 217 may be fixed (e.g., between the first and second arms 222, 224), e.g., by using a threaded nut or other type of attachment member (see FIGS. 1 and 3), such that the barrel body 208 rotates about the axial rod 217. In other embodiments, the axial rod 217 also may rotate. Other elements, such as bearings, also may be implemented. In any event, it is understood that the axial rod 217 provides the axis of rotation for the barrel 202 within the barrel support assembly 216.

In other embodiments, the through hole 219 may not necessarily extend all the way through the barrel body 208, but instead, may extend partially inward from the barrel's first end 204 and partially inward from its second end 206. In this embodiment, the axial rod 217 may comprise two axial rods 217, one coupled to the barrel support assembly's first arm 222 and that passes into the barrel's through hole 219 on its left side 204 and one coupled to the barrel support assembly's second arm 224 and that passes into the barrel's through hole 219 on its right side 206. In this way, the barrel body 208 may rotate about the first and second axial rods 217 on either side.

It is understood that any combination of holes and pins on the barrel body 208 and/or on the first and second arms 222, 224 may be used to rotatably couple the barrel body 208 to the first and second arms 222, 224.

In some embodiments, the distance between the first and second arms 222, 224 is chosen to generally correspond to the width of the barrel 202 between its first and second ends 204, 206 so that the barrel 202 may be rotatably coupled to the first and second arms 222, 224 as shown in FIG. 1. In this way, the barrel 202 may be configured to rotate freely and independently of the handle assembly 100.

In some embodiments, the barrel 202 may be removed from the barrel support assembly 216 for cleaning, maintenance, replacement, etc. This may be accomplished by detaching at least one end of the axial rod 217 from the barrel support assembly 216 and removing the barrel 202 from the axial rod 217.

In some embodiments, the outer circumferential surface 210 of the barrel 202 may be smooth and/or may include a surface texture. In this way, cosmetics (e.g., liquid eyeliner, liquid eyeshadow, etc.) may be applied to the surface 210 and the barrel 202 may be rolled over the user's skin to apply (transfer) the makeup thereto. As can be appreciated, depending on the amount of cosmetic applied to the surface 210 of the barrel 202, different visual effects may be created on the user's skin, such as, without limitation, a gradient effect, an ombre effect, and other types of effects.

In some embodiments, the outer circumferential surface 210 may include embossed structures 212 and/or patterns. In this way, cosmetics, or other types of substances (e.g., face paint, dyes, glitter, adhesives, etc.) may be applied to the embossed structures 212 and subsequently transferred to the user's skin in a pattern that generally matches the pattern of the structures 212. In some embodiments, the embossed structures 212 may be formed directly on the barrel's outer circumferential surface 210, while in other embodiments, the embossed structures 212 may be formed separately and then attached to the barrel's outer circumferential surface 210. For example, in some embodiments, the embossed structures 212 may be formed on an outer surface of a flexible section that may be wrapped around or otherwise attached to the barrel's circumferential surface 210. Other attachment techniques also may be used. In any event, it is understood that the embossed structures 212, once coupled to the barrel body 202 by adequate means may be considered as included on the barrel's outer circumferential surface 210.

For example, in some embodiments, the embossed structures 212 may include a pattern of stars and celestial bodies. Colored cosmetics may be applied to the pattern and upon rolling the barrel 202 on the user's skin, the colorful pattern of stars and celestial bodies may be applied to the skin. It is understood that the embossed structures 212 may include any type of structure and/or pattern (e.g., butterfly wings, hearts, stars, tears, etc.), and that the scope of the device 10 is not limited in any way by the types of structures and/or patterns used.

In some embodiments, the embossed structures 212 include embossed artwork that may be transferred to the user's skin. In some embodiments, the artwork may include an embossment of a particular image or scene that a user may wish to transfer to their skin. For example, the embossed artwork may include an image that has a specific starting point and a specific end point (e.g., a butterfly on a flower). This is in contrast to patterns of images that may simply repeat (also contemplated). In the case of an image with specific starting and ending points, it may be preferable that the device 10 provide feedback to the user regarding where to start the rolling of the barrel 202 and where to end the rolling of the barrel 202. In this way, the image may be transferred in its entirety while not repeating any portion of the image.

In some embodiments, an embossment of an image may be formed using the embossed structures 212 the outer circumferential surface 210 of the barrel 202 such that the image may be transferred in its entirety with one full rotation of the barrel 202 on the user's skin. In other embodiments, an embossment of an image may be formed using the embossed structures 212 on the outer circumferential surface 210 such that the image may be entirely transferred with less than a full rotation of the barrel 202, e.g., with one-half rotation, with one-third rotation, etc. In one example, the embossed structures 212 may form a first image followed by a second image about the circumference of the outer surface 210 such that the first image may be transferred with the first partial rotation of the barrel 202 (e.g., the first one-half rotation), and a second image may be transferred with a second partial rotation of the barrel 202 (e.g., the second one-half rotation).

Figure 3:
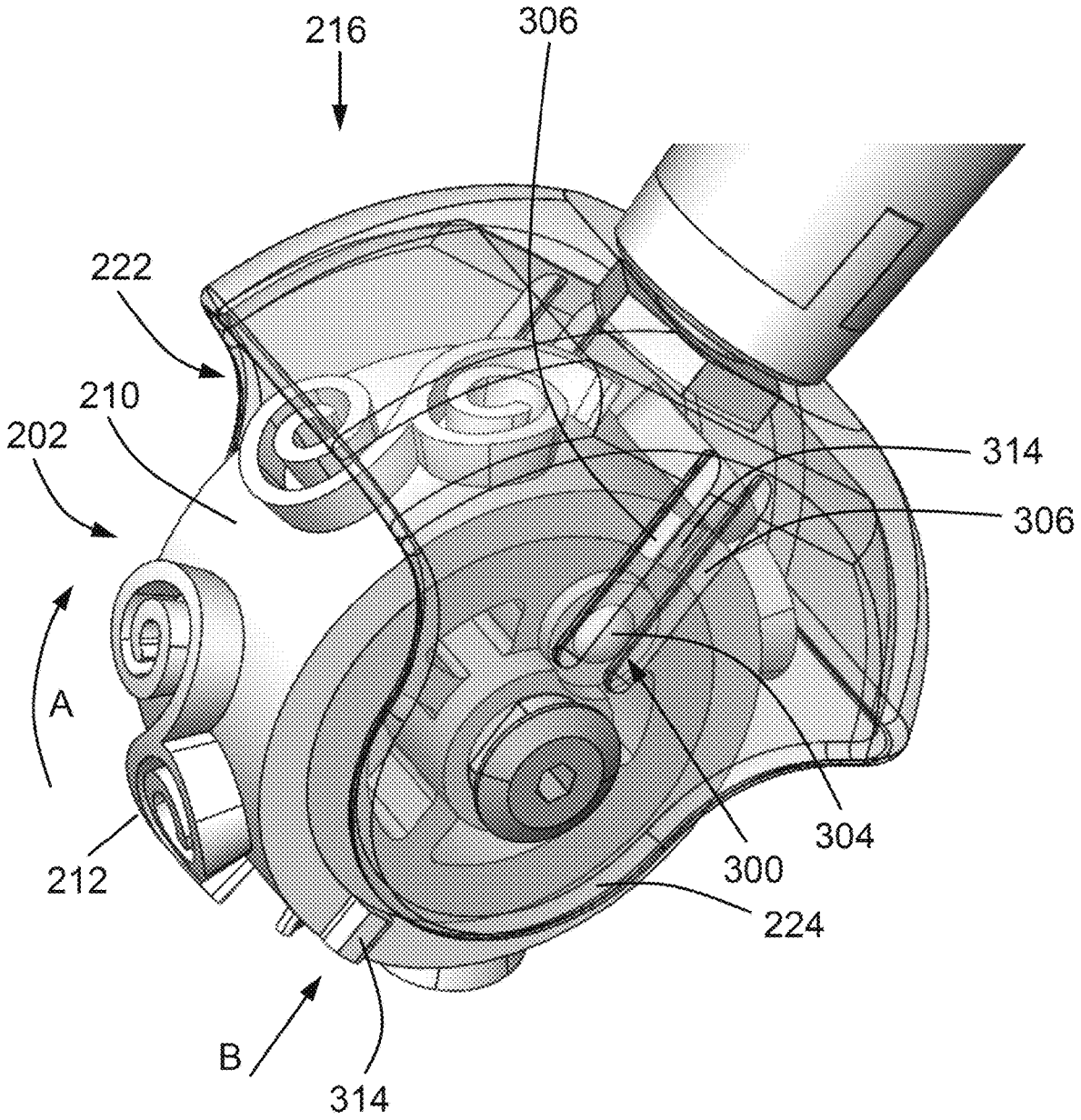
FIG. 3 shows a transparent view of a roller assembly and a feedback system according to exemplary embodiments hereof.
Figure 4:
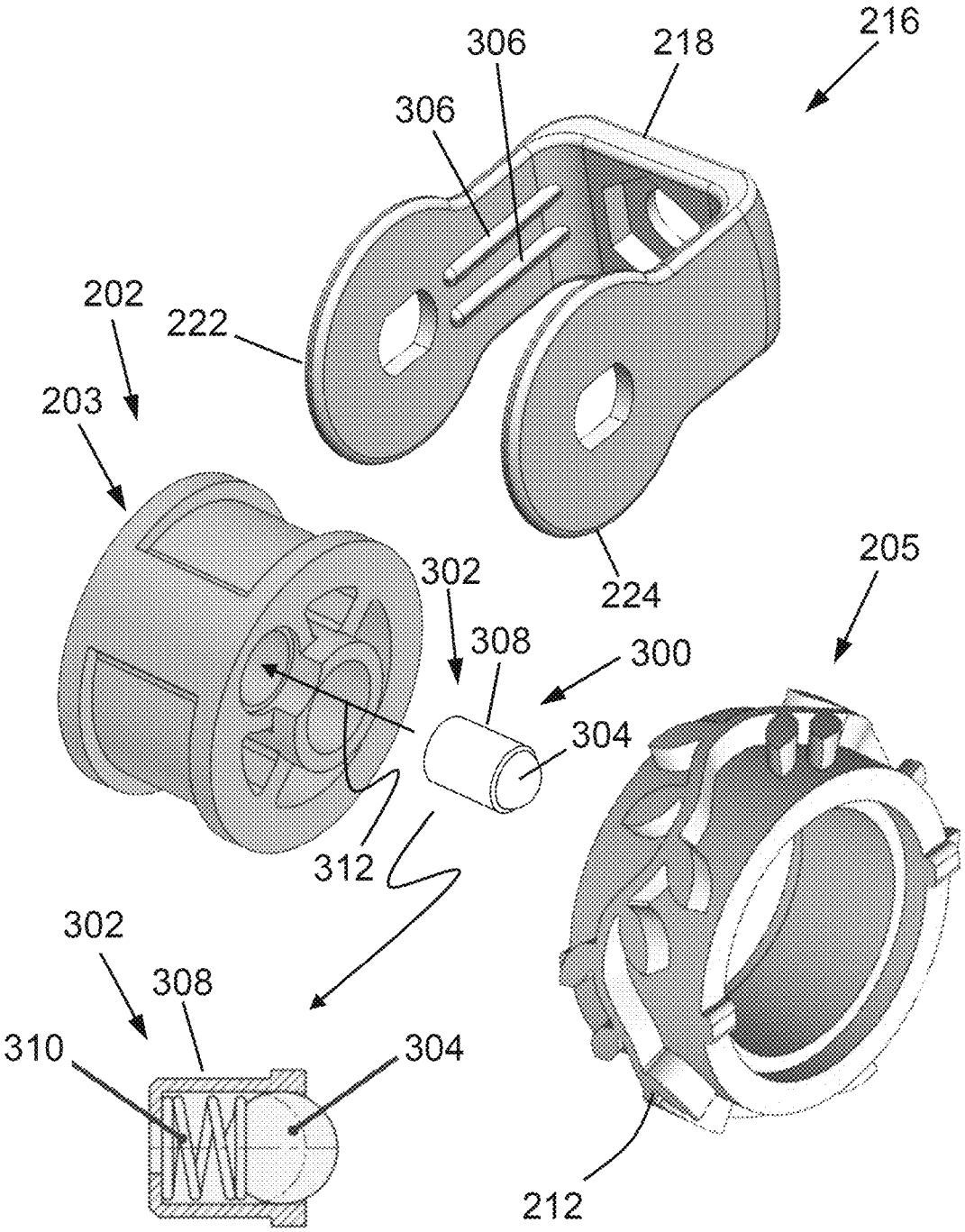
FIG. 4 shows an exploded view of a roller assembly and a feedback system according to exemplary embodiments hereof.

In some embodiments, as shown in FIGS. 3-4, in order to provide the user with an indication as to when an image may be entirely transferred to the skin, e.g., after a full or partial rotation of the barrel 202, the device 10 includes a feedback system 300.

In some embodiments, the feedback system 300 provides an indication as to where and when to begin the barrel rotation on the skin, and where and when to stop the barrel rotation on the skin. In this way, a user may be instructed where to place the barrel 202 on the skin in a position that corresponds to the beginning of the embossed image, how far to roll the barrel 202 so that the entire image is transferred to the skin, and when to stop the rotation of the barrel 202 upon completion such that no portion of the image is repeated.

In some embodiments, the feedback system 300 provides haptic feedback to the user as the user uses the device 10. In some embodiments, the haptic feedback is provided by a haptic mechanism 302. In some embodiments, as shown in FIGS. 3-4, the haptic mechanism 302 includes a spring-loaded ball 304 and one or more corresponding raised ridges 306 (or sunken grooves). In some embodiments, the spring-loaded ball 304 is configured with the barrel 202 and the ridges 306 are configured on an inner side of the first and/or second arms 222, 224 of the barrel support assembly 216. It also is contemplated that the spring-loaded ball 304 may be configured with one or both of the first and/or second arms 222, 224 and that the corresponding raised ridges 306 (or sunken grooves) may be configured with the first or second ends 204, 206 of the barrel body 202.

As shown in FIG. 4, the spring-loaded ball 304 is housed within a shell 308 (e.g., a small tube) along with the spring 310 that provides an outward bias to the ball 304. The shell 308 is received into a corresponding opening 312 in the side of the barrel 202 (e.g., in the inner barrel portion 203) such that the ball 304 extends slightly outward from the side of the barrel 202. In this way, as shown in FIG. 3, when the barrel 202 is configured between the first and second arms 222, 224 of the barrel support assembly 216, the ball 304 may engage the raised ridges 306 upon rotation of the barrel 202.

In the example shown in FIGS. 3 and 4, two side-by-side and generally parallel raised ridges 306 are configured to receive the spring-loaded ball 304 within the gap between the raised ridges 306. It also is understood that the gap may be provided by a sunken groove. During use, as the barrel 202 rotates (e.g., in the direction of the arrow A) and the ball 304 engages a first ridge 306, the spring 310 compresses inward thereby allowing the ball 304 to move inward and pass over the ridge 306. Upon clearing the first ridge 306, the ball 304 may rest within the gap between the side-by-side ridges 306 with the spring 310 applying an outward bias thereto. In this position, the ball 304 is releasably held within the gap by the bias provided by the spring 310. This provides a haptic feedback to the user as the user feels the ball 304 engage the first ridge 306 (i.e., feels the resistance to the rotation of the barrel 202 provided by the engagement) and as the user subsequently feels the ball 304 releasably held within the gap between the two raised ridges 306.

In some embodiments, this haptic feedback is designed to indicate the rotational position of the barrel, e.g., with respect to the handle 100, and e.g., the rotational position of the artwork provided by the embossed structures 212 thereon. For example, the portion of the embossed structures 212 that provide the beginning of an artwork image may be aligned at the far distal end of the device 10 as indicated by the arrow B in FIG. 3 when the ball 304 is engaged between the ridges 306 as shown. In this way, with the ball 304 releasably held, the user may know that the beginning of the the artwork image or embossed structures 212 are positioned on the barrel 202 at the outer far distal end of the device 10. The user may then press the distal end of the device 10 onto the skin and begin rotating the barrel 202 to transfer the image.

In some embodiments, if the artwork image requires a full rotation of the barrel 202 to transfer the complete image, the user simply applies the full image by rotating the barrel 202 until the ball 304 is re-engaged between the ridges 306. This may signify one full rotation of the barrel 202. In another example, if the image requires a one-half rotation of the barrel to transfer the entire image, the barrel 202 may include a second haptic mechanism 302, e.g., a second spring-loaded ball 304 at an offset of 180° from the first spring-loaded ball 304 so that the second spring-loaded ball 304 may engage the ridges 306 thereby providing the haptic feedback to the user after a one-half rotation of the barrel 202. It is understood that any number of haptic mechanism 302 (e.g., any number of spring-loaded balls 304) may be configured at any positions along the barrel 202 such that the balls 304 may engage the ridges 306 at any desired rotational position of the barrel 202 to provide the desired haptic feedback depending on the artwork being transferred. It also is understood that the that the scope of the device 10 is not limited in any way by the placement of the feedback mechanisms 302.

Other arrangements of the haptic devices 302 also are contemplated. For example, the spring-loaded ball 304 may be configured with the outer circumferential surface 210 of the barrel 202 such that it faces outward radially, and the corresponding ridges 306 may be configured with the support beam 218 (or at any other suitable position on the barrel support assembly 216) to releasably engage the spring-loaded ball 304 and to provide haptic feedback to the user thereby.

In some embodiments, other types of feedback mechanisms 302 also may be used. For example, in some embodiments, the haptic mechanisms 302 may comprise opposing magnets, e.g., with a first magnet configured in a location similar to the location of the spring-loaded ball 304 described herein, and a second magnet configured in a location similar to the location of the ridges. In this way, as the first and second magnets come into alignment the magnetic force between the magnets causes the magnets to be releasably held in place. In this case, additional force may be required to disengage the magnets. As with the spring-loaded ball 304 and corresponding ridges 306, as the magnets engage and are subsequently disengaged, haptic feedback is provided to the user's sense of touch. It also is understood that the haptic mechanism 302 may include detents, bumps, grooves, other types of mechanisms that may provide haptic feedback when engaged, and any combinations thereof.

In some embodiments, the feedback system 300 also may provide visual feedback to the user to indicate the rotational position of the barrel 202 of the corresponding position of the artwork provided by the embossed structures 212. For example, as shown in FIG. 3, the barrel 202 (e.g., the outer barrel portion 205) may include an alignment tab 314 (or types of tick marks, start and stop points, notches, insignias, etc.) visibly located at various desired rotational alignments. In the example of FIG. 3, a first alignment tab 314 is located adjacent to and generally rotationally aligned with the spring-loaded ball 304, and a second alignment tab 314 is located at an offset of 180° from the first alignment tab 314 (and from the first spring-loaded ball 304). In this way, the second alignment tab 314 may generally indicate a one-half rotation with respect to the first alignment tab 314. It is understood that any number of alignment tabs 314 may be provided at any positions along the barrel 202 that may indicate any desired rotational alignment positions. Other types of visual feedback members are also contemplated.

It can be seen that for other barrels 202 with other numbers of embossed images, any number of haptic mechanisms 302 may be placed to correspond to any number of embossed image starting points.

In some embodiments, the barrel 202 may include an internal cavity that may contain the cosmetics (e.g., in liquid, gel, and/or powder form) and a self-application mechanism (e.g., a hole or nozzle) that may apply the cosmetics to the barrel's outer surface 210 for application to the user's skin.

In some embodiments, a first roller assembly 200 may be configured with the first end 104 of the handle assembly 100 and a second roller assembly 200 (or any other accessory) may be configured with the second end 106 of the handle assembly 100.

It is understood that any aspect and/or element of any embodiment of the device 10 described herein or otherwise may be combined with any other aspect and/or element of any other embodiment described herein or otherwise in any way to form additional embodiments of the device 10 all of which are within the scope of the device 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A method of applying cosmetics comprising:

(A) providing a cosmetic roller applicator;

the cosmetic roller applicator comprising:

a roller, a roller support rotatably supporting the roller; and a haptic feedback system comprising a first haptic mechanism disposed on the roller and a second haptic mechanism disposed on the roller support;

(B) applying cosmetics to an outer circumferential surface of the roller, the outer circumferential surface including at least one embossed structure;

(C) rolling the outer circumferential surface on a person's skin;

(D) receiving a sense of touch haptic feedback from the haptic feedback system when the roller is rotated to a first rotational position;

wherein the sense of touch haptic feedback is defined by an interaction between the first haptic mechanism and the second haptic mechanism where the first haptic mechanism includes a spring-loaded ball housed within a shell and the second haptic mechanism includes at least one ridge or groove.

2. The method of claim 1 further comprising:

(E) stopping the rolling of the outer circumferential surface on the person's skin when the sense of touch haptic feedback is received.

3. The method of claim 1 wherein the at least one embossed structure includes a starting point with respect to the roller's outer circumferential surface and a stopping point with respect to the roller's outer circumferential surface, and the haptic feedback system is adapted to provide the sense of touch feedback when the starting point and/or the stopping point are rotated to the first rotational position.

4. The method of claim 1 wherein the at least one embossed structure includes a first starting point with respect to the roller's outer circumferential surface and a first stopping point with respect to the roller's outer circumferential surface, and a second starting point with respect to the roller's outer circumferential surface and a second stopping point with respect to the roller's outer circumferential surface, and the haptic feedback system is adapted to provide the sense of touch feedback when the first starting point and/or the first stopping point are rotated to the first rotational position, and/or when the second starting point and/or the second stopping point are rotated to a second rotational position.

* * * * *